US011069498B2

(12) United States Patent
Koprivsek et al.

(10) Patent No.: US 11,069,498 B2
(45) Date of Patent: Jul. 20, 2021

(54) DIRECT CURRENT ELECTRIC CIRCUIT INTERRUPTING SWITCH ASSEMBLY WITH AN ACTUATOR

(71) Applicant: NELA RAZVOJNI CENTER ZA ELEKTROINDUSTRIJO IN ELEKTRONIKO, D.O.O., Zelezniki (SI)

(72) Inventors: Mitja Koprivsek, Izlake (SI); Brane Lebar, Zagorje ob Savi (SI)

(73) Assignee: NELA RAZVOJNI CENTER ZA ELEKTROINDUSTRIJO IN ELEKTRONIKO, D.O.O., Zelezniki (SI)

( * ) Notice: Subject to any disclaimer, the term of this patent is extended or adjusted under 35 U.S.C. 154(b) by 0 days.

(21) Appl. No.: 16/636,108

(22) PCT Filed: Dec. 20, 2017

(86) PCT No.: PCT/SI2017/000035

§ 371 (c)(1),
(2) Date: Feb. 3, 2020

(87) PCT Pub. No.: WO2019/027374

PCT Pub. Date: Feb. 7, 2019

(65) Prior Publication Data

US 2021/0166902 A1 Jun. 3, 2021

(30) Foreign Application Priority Data

Aug. 1, 2017 (SI) ..... P-201700227
Nov. 15, 2017 (SI) ..... P-201700309

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... B60R 16/03; H01H 39/006; H01H 2039/008; H02J 7/0031
See application file for complete search history.

(56) References Cited

U.S. PATENT DOCUMENTS 3,851,219 A * 11/1974 Kozorezov ..... H01H 9/54 361/103
5,990,572 A * 11/1999 Yasukuni ..... H01H 39/006 180/271

(Continued)

FOREIGN PATENT DOCUMENTS

DE 102008044774 A1 10/2009
DE 102016124176 A1 1/2017

OTHER PUBLICATIONS

International Search Report and Written Opinion dated Apr. 18, 2018 issued in related PCT App. No. PCT/SI2017/000035 10 pages).

*Primary Examiner* — Jacob R Crum
(74) *Attorney, Agent, or Firm* — William B. Nash; Jason Whitney; Haynes and Boone, LLP

(57) ABSTRACT

A direct current interrupting switch assembly comprising a primary conductor and secondary conductor integrated with a voltage source and load. The primary conductor has two parallel branches, the first branch including a fuse with a melting member and the second branch including a pyro-switch with an interrupting member. In a first position, the second branch of the primary conductor is uninterrupted, and the interrupting member is a sufficient distance apart from the secondary conductor. When the interrupting member is moved to a second position, the current in second branch of the primary conductor is interrupted an the inter- (Continued)

rupting member contacts the secondary conductor of the switch assembly. The switch assembly also has a parallel circuit with a thermal fuse with a contact member, and an electromagnetic switch; which activates when a pre-determined value of electric current is exceeded.

7 Claims, 1 Drawing Sheet

(56) References Cited

U.S. PATENT DOCUMENTS

| | | | | |
|---|---|---|---|---|
| 9,221,343 | B2 | 12/2015 | Tokarz et al. | |
| 2008/0137253 | A1* | 6/2008 | George | H01H 39/006 361/93.1 |
| 2013/0154352 | A1* | 6/2013 | Tokarz | B60L 3/0046 307/9.1 |
| 2016/0225558 | A1* | 8/2016 | Chatroux | H01H 39/004 |
| 2016/0288619 | A1* | 10/2016 | Andrews | H02H 7/0852 |
| 2018/0277325 | A1* | 9/2018 | De Palma | H01H 85/04 |

* cited by examiner

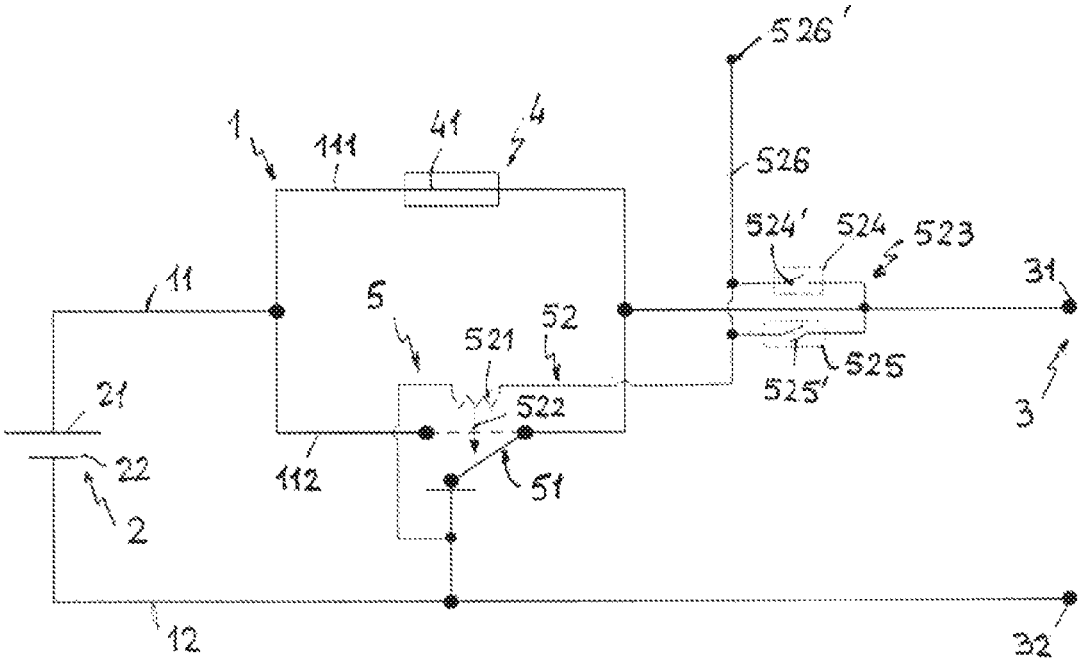
526'
1
111
41
4
526
524'
524
523
11
5
52
31
521
525
525'
21
522
3
22
112
51
2
12
32

DIRECT CURRENT ELECTRIC CIRCUIT INTERRUPTING SWITCH ASSEMBLY WITH AN ACTUATOR

CROSS-REFERENCE TO RELATED APPLICATIONS

This application is a United States national phase application of co-pending international application number PCT/SI2017/000035, filed on Dec. 20, 2017, which claims the benefit of Slovenia Patent Application Nos. P-201700227, filed on Aug. 1, 2017, and P-201700309, filed on Nov. 15, 2017, all of which are hereby incorporated by reference in their entireties.

BACKGROUND

The present disclosure refers to direct current electric circuit interrupting switch assemblies, and more particularly to such switches and switch assemblies activated by means of explosion and initiated based on electric current.

The present disclosure arises from the a problem of how to create a small and simple switch assembly, which should on the one hand be capable to withstand long-term repeating induction-related influences as well as dynamic current loadings (i.e. variations of the electric current value within each direct voltage (DC) electric circuit), and which should on the other hand by activation thereof enable prompt interruption of said electric circuit regardless of the value of the electric current and without formation of an electric arc, and which should at the same time ensure a total electric insulation of each electric load(s) from each electric voltage source regardless of the value of the electric current and voltage, wherein such switch assembly should be furnished with its own actuator, which should reliably react both to electrical and mechanical overloads, e.g. in a car crash situation, and should therefore provide a completely autonomous assembly suitable for mounting and functioning independently of any other assemblies, which may serve for various purposes and are available in each vehicle or any other apparatus, in which said switch assembly is to be mounted.

A direct current electric circuit interrupting switch assembly providing some of such features is described in a pending Slovenian patent application No P-201700227. However, in the switch assembly discussed therein, said actuator in critical circumstances, namely in the case of mechanical overload, in particular in a crash situation, receives a required impulse or signal either from a sensor for monitoring values of the electric current in each electric circuit, or from any other sensor for monitoring any other physical value available in each desired location within the apparatus in which said switch assembly is mounted. In such case, functioning of the switch assembly depends on functioning of each other device from which said actuator should receive a signal required for triggering and displacement of the interrupting member. By practical application this would mean that the actuator of such switch assembly must be adapted to each particular assembly, from which the triggering signal should be received, so that also the reliability by functioning of such switch assembly absolutely depends on reliability of each other device, from which the actuator should receive a signal as required for triggering thereof.

Another direct current electric circuit interrupting switch assembly is disclosed in U.S. Pat. No. 9,221,343 B2 (Tesla Motors, Inc.). Such switch assembly includes a direct electric voltage source, which is electrically connected with each load via primary and secondary conductor. Such assembly is generally suitable for mounting into electric vehicles and serves for interruption of an electric circuit in emergency situations, e.g. by vehicle crash. In practice, the electric voltage source is a battery or a set of mutually interconnected batteries, while said load is an inverter, via which each further electric circuits are supplied by electricity, which serve e.g. for driving vehicles, lighting, heating and air-conditioning, driving of servomotors, or the like. Regarding the discussed solution in U.S. Pat. No. 9,221,343 B2, the secondary electric conductor continuously extends between the negative terminal of the electric energy source and corresponding connecting terminal of the load. The primary electric conductor, which extends between the positive terminal of said direct voltage electric source and the residual connecting terminal of the load is bifurcated and consists of two separate branches, which are in parallel connected with each other, wherein in the first branch an electric fuse with a melting member is integrated, while the second branch includes a pyro switch, which is during regular operation of the electric circuit uninterrupted. Said pyroswitch is furnished with a casing, through which extends an electric conductor, which in this particular case corresponds to said second branch of the primary conductor. In the interior of said casing a blade in form of guillotine is integrated, which consists of an electrically insulating material and which is during regular operation of the electric circuit maintained at certain distance apart from said conductor, however, it is in principle by means of a pyrotechnic actuator also movable towards the conductor, when required. Activation of said actuator occurs based on a signal, which is received by actuator either from a sensor monitoring values of electric current within the electric circuit, or optionally from any other suitable sensors, e.g. from the sensor that serves for activation of inflatable airbags within each vehicle. By activation of such switch, both sections of such interrupted electric conductor are deflected apart from each other and remain in such state split apart from each other and also from any other electrically conductive component.

A pyroswitch is generally commercially available in two embodiments, namely in normally interrupted (NO—normally open) and normally uninterrupted (NC—normally closed). In the discussed solution in U.S. Pat. No. 9,221,343 B2, such switch is during regular operation uninterrupted, but can be interrupted in any need, by which the electric circuit is interrupted. Normally closed switches are much more bulky and are therefore unsuitable for use in electric powered vehicles.

In addition to low electricity power loses such pyroswitch also excels in extremely short reacting time by activation i.e. interruption of each electric circuit, which is performed within approx. 1 ms. On the other hand, such switches are problematic in view of potential variations of properties of chemical reactants contained therein during the time and due to temperature variations, and in addition to that, also in view of voltage overloads and induction-related phenomena. Consequently, during each regular operation of the switch assembly both conductors are connected on the one hand with the electric voltage source, and on the other hand with each electric load, by which the electric current due to relatively high resistance of the melting member within the electric fuse the electric current is merely conducted through those branch, in which said pyroswitch is integrated. In such manner, in particular by using such switch assemblies in the electric vehicles, deficiencies related to electric fuses with melting member, which are unable to withstand durable dynamic current overloads, are minimized. Namely, during utilization of electric fuses in electric vehicles, it has been found that physical properties of the material of the melting member may, due to long-term varying the values of current conducted there-through, be changed in such extent that any further reactions of the melting member during the forthcoming current loadings becomes relatively unpredictable and unreliable.

When said switch assembly according to U.S. Pat. No. 9,221,343 B2 is exposed to such current overloading of the electric circuit, in which it is integrated, it should react by interrupting the primary electric current on the basis of a received signal, by which first of all said pyroswitch is activated, which results in interruption of current within the corresponding branch, upon which the current may still be conducted through the other branch i.e. through the melting member of the electric fuse, which then starts to melt, by which the electric circuit throughout the switch assembly i.e. between the electric voltage source and each electric load becomes completely interrupted. In case of substantial current overloads, in which the current exceeds a multiple value of a nominal current limit value in the electric fuse, interruption of the melting member is performed relatively quickly, which in practice means within approximately 20 ms. However, when using such switch assembly in vehicles, the current overloads in particular during a smooth drive are usually not so high. In such case, by vehicle crash said actuator should normally trigger the pyroswitch, by which the belonging branch of the primary conductor in the electric circuit is interrupted, upon which the current is re-directed through the residual branch of said conductor. When the current overload is just slightly above the nominal value of the electric fuse, then melting of said melting member may take several minutes or even more than one hour, which is in any crash situation quite unacceptable and dangerous due to the risk of establishing short circuits and/or electric arc. In addition to that, even in the case of quick and successful interruption of the primary conductor in the electric circuit between the direct voltage electric circuit and each electric load, the secondary conductor still remains uninterrupted and connected with both with electric voltage source and the electric load. In particular in vehicles this deficiency may lead to problems, since said electric load is in the one hand connected with said electric voltage source, and on the other hand also with various electric circuits, where some of these may also contain capacitors, in which electric capacity still remains stored and which may represent additional electric voltage sources, which persist active despite to interruption of the primary electric conductor of such switch assembly. Such "hidden" electric voltage sources may also be extremely dangerous in said vehicle crash situations.

An electromagnetic switch of the previously described art is as such known to persons skilled in the art and is e.g. disclosed in U.S. Pat. No. 5,847,632 A. Such switches are functioning on the basis of variations of electromagnetic field die to displacement of a magnet exposed to accelerations, which is correlated to changing of mechanical loads and/or deformations.

Moreover, a parallel circuit comprising a pyrotechnic fuse as well as another fuse is disclosed in DE 10 2008 044 774 Ab1. Still further, an electric interrupting switch for interrupting at high currents and high voltages is disclosed in DE 10 2016 124 176 A1.

BRIEF DESCRIPTION OF THE DRAWING

FIG. 1 is a schematic drawing of an embodiment of the switch assembly of the present disclosure.

DETAILED DESCRIPTION

The present disclosure refers to a direct current electric circuit interrupting switch assembly, which is upon establishing of electric connection via primary electric conductor and secondary electric conductor suitable for integration between a direct voltage electric source and at least one load, so that by means of said conductors of the switch assembly a primary terminal of said electric source is electrically connectable with a primary terminal of each electric load, and a secondary terminal of said electric source is electrically connectable with a secondary terminal of each electric load. Said primary electric conductor of the switch assembly comprises two branches, which are in parallel connected with each other, wherein the first branch includes an electric fuse with a melting member, and the second branch includes a pyroswitch with an interrupting member, which is capable to interrupt said second branch of the primary electric conductor extending through said pyroswitch, as well as with an actuator, which is capable to ensure appropriate movement of said interrupting member due to interruption of said second branch of the primary electric conductor by means of explosion of at least one chemical reactant contained therein by means of an electric impulse received either from a sensor for monitoring of electric current value in each electric circuit, or from any other sensor suitable for monitoring at least one physical characteristic available in each desired location in any apparatus, in which said switch assembly is integrated.

Said pyroswitch comprises such an interrupting member, which is within said pyroswitch displaceable from its first i.e. initial position, in which by means of it said second branch of the primary electric conductor is uninterrupted and in which said interrupting member is held at a sufficient distance apart from the secondary electric conductor, into its second i.e. shifted position, in which the electric circuit throughout the second branch of the primary electric conductor is interrupted and the interrupting member is held in an electric conductive contact with the secondary conductor of the switch assembly.

According to the present disclosure, said actuator is via said interrupting member connectable with the secondary conductor of the switch assembly and comprises an electric initiating component, which is suitable for initiation of explosive chemical reaction of at least one chemical reactant contained therein by means of an electrical impulse;

a pushing member, which is during said chemical reaction of said reactant upon activation of said initiating component displaceable in a direction towards the interrupting member in order to assure displacement of said interrupting member from its initial position in contact with the primary conductor and apart from the secondary conductor into its secondary position in contact with the secondary conductor; as well as an electric circuit, which is in addition to said parallel branches integrated in said primary electric conductor in such a manner, that it is connected with said electric voltage source and said load in serial with said branches of the primary conductor, wherein said electric circuit consists of at least one irreversible thermal electric fuse with a contact member, which is during the regular operation of the switch assembly interrupted and is closed i.e. set into uninterrupted state only when an electric overload occurs, as well as of at least one electromagnetic reed switch with an interrupting member, which is during regular operation of the switch assembly interrupted and is closed i.e. set into uninterrupted state only when a pre-determined value of the electric current within the switch assembly is exceeded. Said fuse of the actuator and said electromagnetic switch of the actuator are connected parallel with each other. Whenever said actuator comprises more than one fuse, then the fuses are connected parallel with each other. And whenever said actuator comprises more than one electromagnetic switch, then all the switches are also connected parallel with each other.

Moreover, at least one additional conductor can be connected to said electric circuit, by means of which said circuit is then connected with at least one external sensor, so that in each critical situation, e.g. in a vehicle crash situation, said actuator is via said additional conductor provided with a signal, which is required for initiation of displacement of the interrupting member and which is received from said external sensor, which is suitable for monitoring electric current within certain circuit, or from any other sensor, which is suitable for monitoring of at least one further physical value available in each desired location in the area of apparatus in which said switch assembly is integrated.

The present disclosure further provides that said interrupting member is a mechanically interruptible and from its initial position to its second position displaceable section of the second branch of the primary electric conductor.

Still further, said switch assembly according to the present disclosure is characterized in that said interrupting member in its second i.e. shifted position, in which the electric circuit through the second branch of the primary electric conductor is interrupted, is held in electric conductive contact with the second electric conductor of the switch assembly, and consequently also in electric contact with each load and also with the secondary terminal of each direct voltage electric source.

Moreover, said electric initiating component can also be connected both with said electric circuit and with at least one additional electric conductor, which is suitable for establishing interconnection with at least one external sensor.

The present disclosure will be explained in some more detail by means of an embodiment, which is schematically presented in FIG. 1.

Direct current electric circuit interrupting switch assembly 1 can establish an electric connection via primary electric conductor 11 and secondary electric conductor 12 integrated between a direct voltage electric source 2 and at least one load 3. In this, by means of said conductors 11, 12 of the switch assembly 1 a primary terminal 21 of said electric source 2 is electrically connectable with a primary terminal 31 of each electric load 3, and a secondary terminal 22 of said electric source 2 is electrically connectable with a secondary terminal 32 of each electric load 3.

Said primary electric conductor 11 of the switch assembly 1 comprises two branches 111, 112, which are parallel connected with each other, wherein the first branch 111 includes an electric fuse 4 with a melting member 41 and the second branch 12 includes a pyroswitch 5.

Said pyroswitch 5 is furnished with an interrupting member 51, which is capable to interrupt said second branch 112 of the primary electric conductor 11 extending through said pyroswitch 5, as well as with an actuator 52, which is capable to ensure appropriate movement of said interrupting member 51 due to interruption of said second branch 112 of the primary electric conductor 11 by means of explosion of at least one chemical reactant contained therein by means of a received electric impulse.

Optionally, said actuator 52 in each critical situation, e.g. by a car crash, can receive an impulse, which is required for initiation of displacement of the interrupting member, either from a component 524, 525 of a sensor, which is suitable for monitoring of electric current value in each electric circuit, or from any other sensor 526', which is suitable for monitoring of at least one further physical characteristic and available in each desired location within the apparatus in which said switch assembly 1 is integrated.

Said pyroswitch 5 of the switch assembly 1 comprises an interrupting member 51, which is within said pyroswitch 5 displaceable from its first i.e. initial position, in which by means of it said second branch 112 of the primary electric conductor 11 is uninterrupted and in which said interrupting member 51 is held at a sufficient distance apart from the secondary electric conductor 12, into its second i.e. shifted position, in which the electric circuit throughout the second branch 112 of the primary electric conductor 11 is interrupted and the interrupting member 51 is held in an electric conductive contact with the secondary conductor 12 of the switch assembly 1.

Said interrupting member 51 may be mechanically actuated from its initial position to its second position which interrupts electric current in the second branch 112 of the primary electric conductor 11.

Consequently, said interrupting member 51 is in its second i.e. shifted position, in which the electric circuit through the second branch 112 of the primary electric conductor 11 is interrupted, held in electric conductive contact with the second electric conductor 12 of the switch assembly 1, and herewith consequently also in electric contact with each load 3 and also with the secondary terminal 22 of the direct voltage electric source 2.

The switch assembly 1 is no doubt simple and is despite to introduction of appropriate pyroswitch 5 not bulky in view of each required space. Thanks to arrangement of said pyro switch 5 and the electric fuse 4 with its melting member 4 into two separate branches 111, 112 of primary electric conductor 11 such switch assembly 1 is capable to withstand temperature variations of temperature variations and is moreover able to deal with inductivity variations as well as dynamic current intensity, i.e. frequently changing of electric current values within each particular direct voltage (DC) electric circuit. On the other hand, said switch assembly enables a prompt interruption of said direct voltage electric circuit on the basis of activation of the actuator 52, e.g. in situation of electrically driven vehicle crash, regardless to each electric voltage and actual value of the electric current, and in particular without establishing an electric arc, by which also each of the electric load(s) become(s) completely insulated with regard to each direct voltage electric source. Thanks to said displacement of the interrupting member 51 from its origin i.e. uninterrupted position into its shifted position in contact with the secondary conductor 12 in each direct voltage circuit, via said switch assembly 1 and each load 3 an additional electric circuit is established, which is completely separated from the electric voltage source 2, and although any additional electric sources remain hidden within such newly established circuit, such sources cannot be brought in contact with the electric source 2.

The present disclosure enables automatic activation of the switch assembly 1, when each pre-determined requirement is met. To this aim, said actuator 52 is, via said interrupting member 51, connectable with the secondary conductor 12 of the switch assembly 1 and comprises an electric initiating component 521, a pushing member 522 as well as an electric circuit 523, which will be one by one explained in more detail.

Said electric initiating component 521 is suitable for initiation of explosive chemical reaction of at least one chemical reactant contained therein by means of an electrical impulse, wherein the chemical structure of said chemical reactant can correspond to those used in pyro-switches which are known in the prior art.

Said pushing member 522 is, during said chemical reaction of said reactant upon activation of said initiating component 521, displaceable in a direction towards the interrupting member 51 just in order to assure displacement of said interrupting member 51 from its initial position in contact with the primary conductor 11 and apart from the secondary conductor 12 into its secondary position in contact with the secondary conductor 12.

Said electric circuit 523 is, in addition to said parallel branches 111, 112, integrated in said primary electric conductor 11 in such a manner that it is connected with said electric voltage source 2 and said load 3 in serial with said branches 111, 112 of the primary conductor 11. In this, said electric circuit 523 consists of at least one irreversible thermal electric fuse 524 with a contact member 524', which is during the regular operation of the switch assembly 1 interrupted and is closed i.e. set into uninterrupted state only when an electric overload occurs, as well as of at least one electromagnetic reed switch 525 with an interrupting member 525', which is during regular operation of the switch assembly 1 interrupted and is closed i.e. set into uninterrupted state only when a pre-determined value of the electric current within the switch assembly 1 is exceeded. Said fuse 524 of the actuator 52 and said electromagnetic switch 525 of the actuator 52 are connected parallel with each other.

Also, in the case when said actuator 52 comprises more than one fuse 524, each of the fuses 524 is connected parallel with each other, and quite similarly, whenever said actuator 52 comprises more than one electromagnetic switch 525, then each of the switches 525 is also connected parallel with each other.

The electric initiating component 521 is connected both with said electric circuit 523 and with at least one additional electric conductor 526, which is suitable for establishing interconnection with at least one external sensor 526'.

A further embodiment is also possible, in which said actuator (52) can be, in a critical situation, e.g. in a vehicle crash situation, provided with a signal which is required for initiation of displacement of the interrupting member (51) and which is via said additional conductor 526 received from said external sensor 526' suitable for monitoring electric current values within certain circuit, or from any other sensor suitable for monitoring of at least one further physical value available in each desired location in the area of apparatus in which said switch assembly 1 is integrated.

Activation of such switch assembly is generally performed either by exceeding current overload or in a short circuit situation.

Activation by exceeding current is performed by means of said irreversible thermal electric fuse 524, which is arranged in a heat conductive contact with conductive components of the switch assembly. By increasing the electric current, the temperature is also increasing, and each activation condition can be defined in advance on the basis of suitable dimensioning or choice of the fuse 524. As soon as the electric current becomes higher than a pre-determined nominal value, conductive components of the pyro-switch start heating, and the fuse 524 with its contact member 524' is also heated. As soon as a pre-determined temperature is reached, the contact member 524' of the fuse 524 is shifted and the electric circuit through the fuse 524 is established i.e. uninterrupted, and the electric current starts flowing therethrough, which is however limited with resistance of the actuator 52, so that in the case of overload said pyroswitch 5 is activated, so the interrupting member 51 is by means of actuator 52 shifted from its initial position in contact with the primary conductor 11 into is secondary position in contact with the secondary conductor 12.

Activation in a short circuit situation is performed by means of said electromagnetic reed switch 525, which is sensitive to the external magnetic field and is capable of reacting within extremely short time periods, e.g. within 50 μs. Said time period is shorter by higher current and correspondingly higher magnetic field strength. Such short activation i.e. triggering time period needs to be achieved in particular due to current withstanding of the pyroswitch in the short circuit conditions. Said electromagnetic reed switch is arranged at appropriate distance apart from conductive components of the pyroswitch 5, and each conditions, in which the electromagnetic switch is reacting to short circuit overload, can also be determined in advance on the basis of adjusting the position of said switch 525, since the sensibility i.e. reactiveness of said switch 525 is reciprocally proportional to the distance from the source of electromagnetic field. When in a short circuit situation, the electric current starts to increase, the electromagnetic field is generated, which impacts the electromagnetic reed switch 525. At a pre-determined magnetic field strength, the contact members 525' in the electromagnetic switch 525 are brought in contact with each other, and the circuit suitable for conducting electric current is herewith established within said switch 525. The current is also in this situation determined i.e. limited by resistance of the actuator 52, and by overloading i.e. by short circuit said pyroswitch 5 is activated, so that by means of said actuator 52 the interrupting member 51 is shifted from its initial position in contact with the primary conductor 11 into its secondary position in contact with the secondary conductor 12.

What is claimed is:

1. A direct current electric circuit interrupting switch assembly comprising:

a primary electric conductor and a secondary electric conductor adapted for integration between a direct voltage electric source and at least one load;

wherein by means of said conductors of the switch assembly a primary terminal of said electric source is electrically connectable with a primary terminal of each electric load, and a secondary terminal of said electric source is electrically connectable with a secondary terminal of each electric load;

wherein the primary electric conductor of the switch assembly comprises two branches, which are in parallel connected with each other, and the first branch includes an electric fuse with a melting member and the second branch includes a pyroswitch with an interrupting member, which is capable to interrupt said second branch of the primary electric conductor extending through said pyroswitch, as well as with an actuator, which is capable to ensure appropriate movement of said interrupting member due to interruption of said second branch of the primary electric conductor by means of explosion of at least one chemical reactant contained therein by means of an electric impulse received either from a first sensor for monitoring of electric current value in each electric circuit or a second sensor for monitoring at least one physical characteristic in an apparatus in which said switch assembly is integrated;

wherein said pyroswitch comprises such interrupting member, which is within said pyroswitch displaceable from a first position, in which by means of it said second branch of the primary electric conductor is uninterrupted and in which said interrupting member is held at a sufficient distance apart from the secondary electric conductor, into a second position, in which the electric circuit throughout the second branch of the primary electric conductor is interrupted and the interrupting member is held in an electric conductive contact with the secondary conductor of the switch assembly;

wherein said actuator is via said interrupting member connectable with the secondary conductor of the switch assembly and comprises:

an electric initiating component suitable for initiation of explosive chemical reaction of at least one chemical reactant contained therein by means of an electrical impulse;

a pushing member, which is during said chemical reaction of said reactant upon activation of said initiating component displaceable in a direction towards the interrupting member in order to assure displacement of said interrupting member from its initial position in contact with the primary conductor and apart from the secondary conductor into its second position in contact with the secondary conductor; and an electric circuit, which is in addition to said parallel branches integrated in said primary electric conductor in such a manner, that it is connected with said electric voltage source and said load in serial with said branches of the primary conductor, wherein said electric circuit consists of at least one irreversible thermal electric fuse with a contact member, which is during the regular operation of the switch assembly interrupted and is closed only when an electric overload occurs, as well as of at least one electromagnetic reed switch with an interrupting member, which is during regular operation of the switch assembly interrupted and is closed only when a pre-determined value of the electric current within the switch assembly is exceeded, wherein said fuse of the actuator and said electromagnetic switch of the actuator are connected parallel with each other.

2. The switch assembly according to claim 1, further comprising at least one additional conductor connected to said electric circuit, wherein said circuit is then connected with at least one external sensor, so that in critical situation said actuator may be, via said additional conductor, provided with a signal, which is required for initiation of displacement of the interrupting member and which is received from said external sensor, which is adapted for monitoring electric current within certain circuit or at least one further physical value said apparatus.

3. The switch assembly according to claim 1, wherein said interrupting member is mechanically actuated from an initial position to a second position within the second branch of the primary electric conductor.

4. The switch assembly according to claim 1, wherein said interrupting member in said second position, in which the electric circuit through the second branch of the primary electric conductor is interrupted, is held in electric conductive contact with the second electric conductor of the switch assembly, and consequently also in electric contact with each load and also with the secondary terminal of the direct voltage electric source.

5. The switch assembly according to claim 1, wherein said electric initiating component is connected both with said electric circuit and with said at least one additional electric conductor, which is suitable for establishing interconnection with at least one external sensor.

6. The switch assembly according to claim 1, wherein said fuse of the actuator comprises a plurality of fuses connected in parallel.

7. The switch assembly according to claim 1, wherein said electromagnetic switch of the actuator comprises a plurality of electromagnetic switches connected in parallel.

* * * * *